US005267591A

United States Patent [19]

Wakabayashi et al.

[11] Patent Number: 5,267,591

[45] Date of Patent: Dec. 7, 1993

[54] DEVICE FOR PREVENTING CONDENSATION OF WATER VAPOR ON FILLING NOZZLE FOR USE IN FILLING APPARATUS

[75] Inventors: Shigeru Wakabayashi; Kazuo Abe; Takeshi Iseki; Yasuji Fujikawa, all of Tokushima, Japan

[73] Assignee: Shikoku Kakoki Co., Ltd., Itano, Japan

[21] Appl. No.: 846,342

[22] Filed: Mar. 5, 1992

[30] Foreign Application Priority Data

Mar. 8, 1991 [JP] Japan ..... 3-043865

[51] Int. Cl.[5] ..... B65B 1/04; B65B 3/04; B67C 3/02

[52] U.S. Cl. ..... 141/90; 141/91; 141/92; 141/93; 141/85

[58] Field of Search ..... 141/89, 90, 91, 92, 141/93, 63, 284, 369, 370, 373, 374, 165, 85, 103, 275, 277, 278, 181, 46, 135, 136, 144, 145, 163, 168, 172

[56] References Cited

U.S. PATENT DOCUMENTS

| | | | |
|---|---|---|---|
| 1,880,257 | 10/1932 | Kiefer | 141/92 |
| 3,481,109 | 12/1969 | Pavey | 141/92 |
| 4,337,802 | 7/1982 | Kennedy et al. | 141/83 |
| 4,964,444 | 10/1990 | Hanérus et al. | 141/90 |

*Primary Examiner*—Henry J. Recla
*Assistant Examiner*—Steven O. Douglas
*Attorney, Agent, or Firm*—Armstrong, Westerman, Hattori, McLeland & Naughton

[57] ABSTRACT

A device for preventing condensation of water vapor on a filling nozzle in the form of a vertical tube, included in a filling apparatus and positioned above a path of transport of containers comprises a downwardly open dry air chamber having the filling nozzle accommodated therein and permitting the container to be moved into and out of the chamber when the container is lifted by a lifter, an injection nozzle disposed as oriented downward above the path upstream from the dry air chamber for injecting dry air into the container to replace air therein, and a cover extending from a position downstream from the injection nozzle at least to the dry air chamber and covering the path from thereabove for preventing the dry air in the container from flowing out.

6 Claims, 2 Drawing Sheets

DEVICE FOR PREVENTING CONDENSATION OF WATER VAPOR ON FILLING NOZZLE FOR USE IN FILLING APPARATUS

BACKGROUND OF THE INVENTION

The present invention relates to a device for preventing condensation of water vapor on a filling nozzle for use in filling apparatus, especially in chilled filling apparatus for filling a liquid of relatively low temperature into containers.

Such apparatus are already known wherein the filling nozzle comprises a double tube, i.e., inner and outer tubes, with a heat-insulating air layer formed between the tubes.

With the conventional apparatus, the inner tube is cooled with the liquid to be filled to the same temperature as the liquid, whereas the temperature of the inner tube encounters difficulity in transmission to the outer tube because of the blocking effect of the heat-insulating air layer. However, it is impossible to completely obviate the transmission of temperature, inevitably permitting condensation of water vapor on the outer surface of the outer tube.

SUMMARY OF THE INVENTION

The main object of the present invention is to provide a device which is adapted to completely prevent condensation of water vapor on the filling nozzle for use in filling appatatus.

In a filling apparatus having a vertical tubular filling nozzle positioned above a path of transport of containers, and a lifter for lifting the container as transported to immediately below the filling nozzle from the path so as to insert the filling nozzle into the container when the container is to be filled, the present invention provides a device for preventing condensation of water vapor on the filling nozzle which device comprises a downwardly open dry air chamber having the filling nozzle accommodated therein and permitting the container to be moved into and out of the chamber when the container is lifted by the lifter, an injection nozzle disposed as oriented downward above the path upstream from the dry air chamber for injecting dry air into the container to replace air therein, and a cover extending from a position downstream from the injection nozzle at least to the dry air chamber and covering the path from thereabove for preventing the dry air in the container from flowing out.

The device of the invention for preventing condensation of water vapor on the filling nozzle comprises a downwardly open dry air chamber having the filling nozzle accommodated therein and permitting the container to be moved into and out of the chamber when the container is lifted by the lifter, so that a dry air atmosphere is maintained around the filling nozzle, consequently preventing condensation of water vapor on the filling nozzle.

The device further comprises an injection nozzle disposed as oriented downward above the path upstream from the dry air chamber for injecting dry air into the container to replace the air therein, and a cover extending from a position downstream from the injection nozzle at least to the dry air chamber and covering the path from thereabove for preventing the dry air from flowing out from the container. At a position upstream from the filling nozzle, therefore, dry air is substituted for the air in the container, and the substituted dry air in the container is prevented from flowing out until the container is brought to immediately below the filling nozzle . Accordingly, even if the filling nozzle is inserted into the container raised by the lifter, it is unlikely that water vapor will condense on the filling nozzle.

DESCRIPTION OF THE PREFERRED EMBODIMENT

Figure 1:
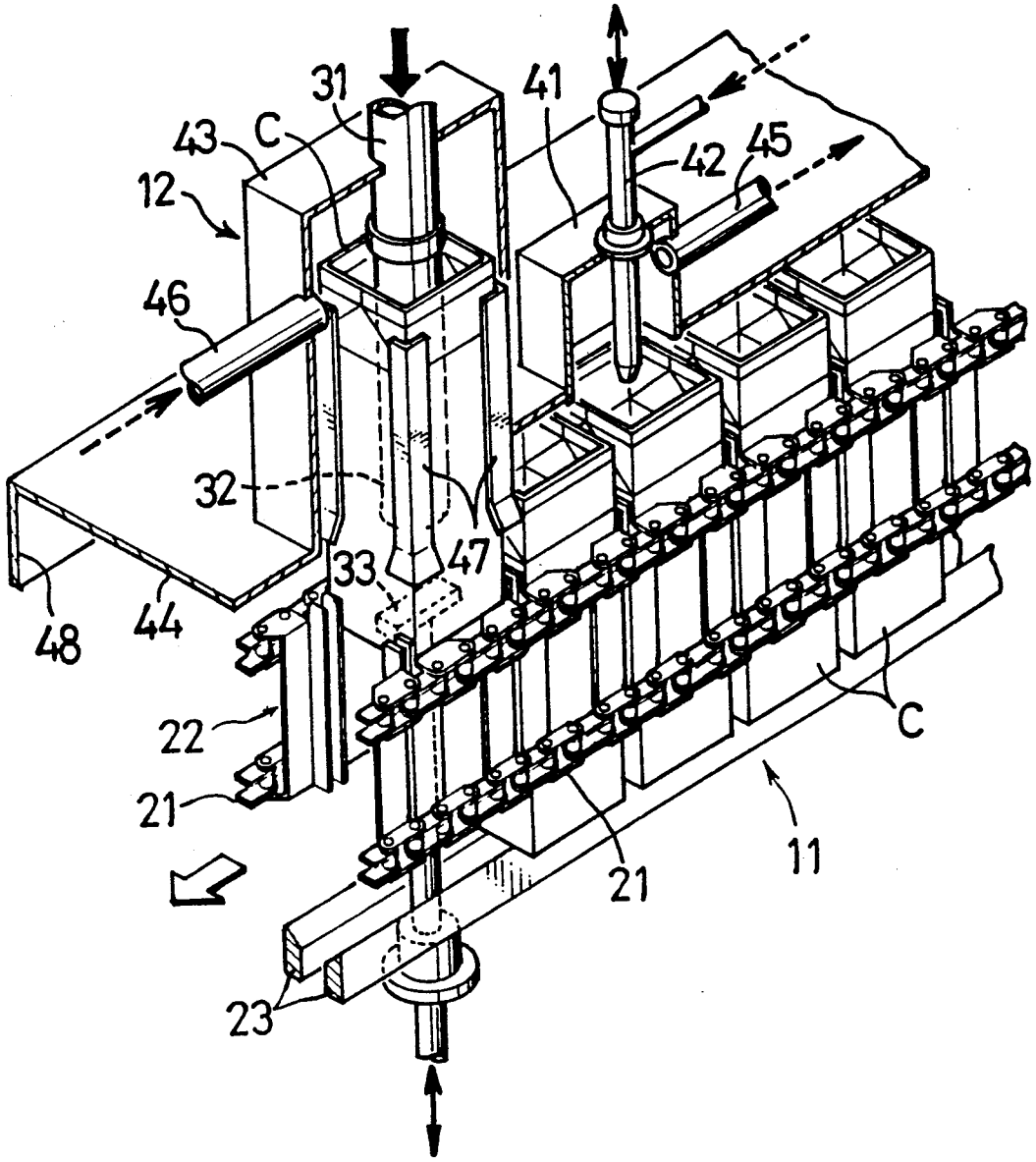
FIG. 1 is a perspective view of a device embodying the invention.
Figure 2:
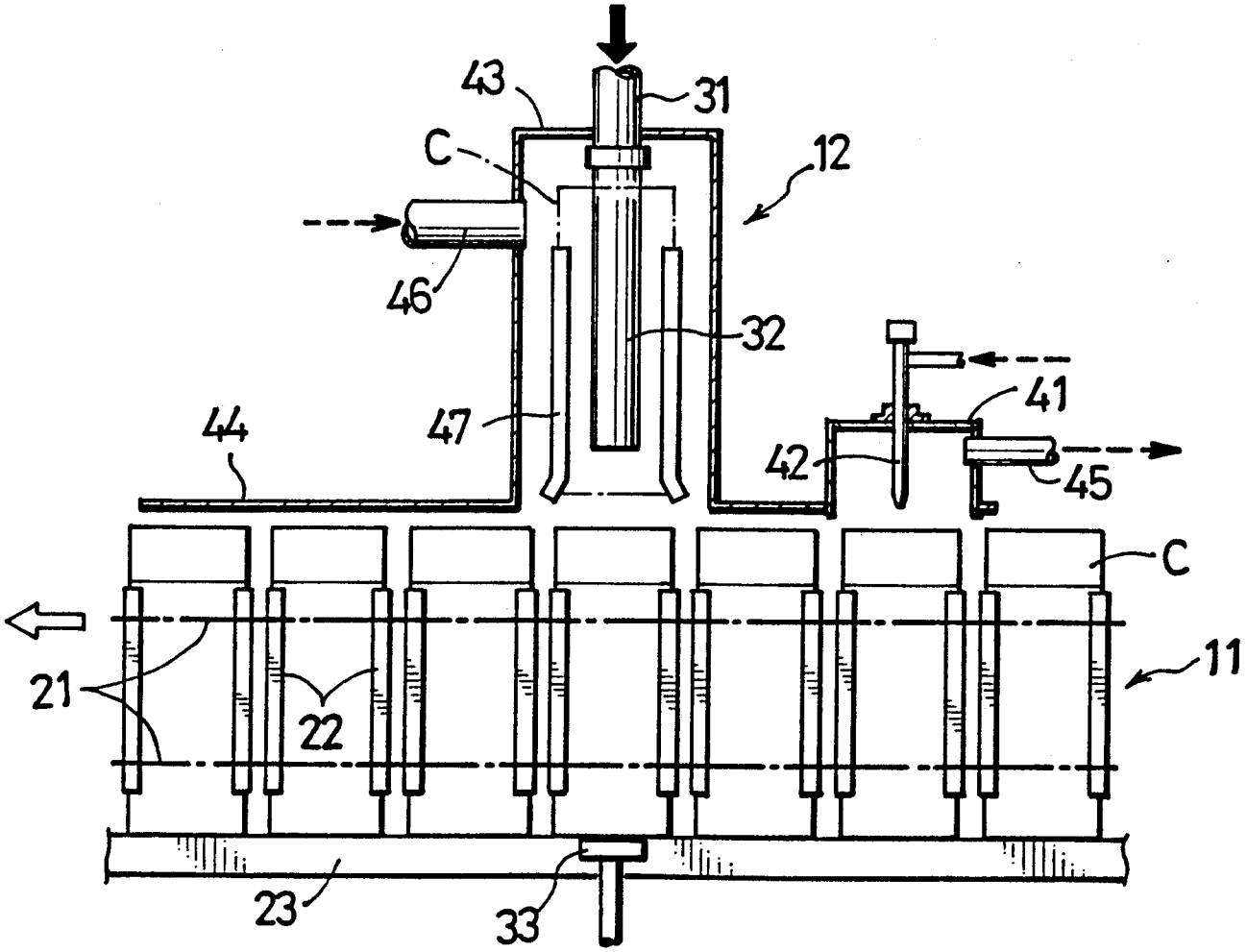
FIG. 2 is a view in vertical section of the device.

An embodiment of the invention will be described below in greater detail with reference to the drawings.

A packaging machine includes a container conveyor 11, and a filling apparatus 12 disposed at an intermediate portion of a path of transport provided by the conveyor.

The conveyor 11 for transporting containers C comprises right and left endless chains 21 which are driven intermittently, a multiplicity of holders 22 mounted on these chains, and rails 23 for supporting the bottoms of containers C as held by the holders 22 to guide the containers.

The filling apparatus 12 comprises a vertical tubular filling nozzle 32 positioned above the path of transport of containers and having an upper end connected to a liquid supply pipe 31, and a lifter 33 for lifting the container C as transported to immediately below the filling nozzle 32 from the path so as to insert the filling nozzle into the container C when the container is to be filled.

A device for preventing condensation of water vapor comprises a downwardly open suction chamber 41 disposed upstream from the filling nozzle 32 above the path of transport, a downwardly oriented dry air nozzle 42 extending through a top wall of the suction chamber 41, a downwardly open dry air chamber 43 housing the filling nozzle 32 therein with a space provided around the nozzle 32 for accommodating the trunk wall of the container C as lifted by the lifter 33, the liquid supply pipe 31 extending through a top wall of the chamber 43, and a cover 44 interconnecting the lower opening-defining edges of the suction chamber 41 and the dry air chamber 43.

The suction chamber 41 is positioned immediately above the container C as located upstream away from immediately below the filling nozzle 32 by two container pitches and is in the form of a box approximately the same as the container C in cross section. The suction chamber 41 has a suction pipe 45 connected to a side wall thereof. The dry air nozzle 42 is supported upwardly and downwardly movably and driven by unillustrated means. The dry air chamber 43 is in the form of a box substantially larger than the container C. The dry air chamber 43 has a side wall, to which a dry air supply pipe 46 is connected. The dry air chamber 43 is internally provided with guides 47 similar to the holder 22 for guiding the upward and downward movement of the container C within the chamber 43 when it is lifted by the lifter 33. The cover 44 is in the form of a horizontal plate having a skirt 48 at each of its opposite side edges and covers the path of transport for preventing dry air from leaking from around the two chambers 41, 43 to the greatest possible extent.

Dry air is continuously supplied to the dry air chamber 43 through the dry air supply pipe 46 to fill up the chamber 43 with the dry air. Accordingly, a dry air atmosphere is maintained around the filling nozzle 32 at all times.

When the container C is transported to immediately below the dry air nozzle 42, the nozzle 42 is lowered and caused to inject dry air into the container C. The injected air substitutes for the air present in the container C while forcing out the air to fill up the container C. The air forced out from the container C is drawn into the suction pipe 45 via the suction chamber 41 and discharged.

The container C filled with the dry air is thereafter transported by two pitches to above the lifter 33. In the meantime, the dry air filling the container C is prevented from flowing out by the cover 44.

When the container C is positioned above the lifter 33, the lifter 33 operates, raising the container C as supported thereon from the conveyor 11 and allowing the filling nozzle 32 to be inserted into the raised container C. In this state, the liquid to be filled is injected from the filling nozzle 32 into the container C filled with the dry air. As the liquid is injected, the liquid level within the container C rises, and the container C is lowered by the lifter 33 with the rise of the liquid level. The container C is returned to the conveyor 11 upon the completion of filling operation.

During the filling operation, the filling nozzle 32 is cooled with the liquid, whereas before, during and after the filling operation, the nozzle 32 is not exposed to the outside air containing water vapor but is in contact with the dry air only. The filling nozzle 32 therefore remains free of the condensation of water vapor.

Air is useful as the dry air insofar as it fulfills the requirement of not permitting condensation of water vapor on the filling nozzle. For example, clean air is usable which is up to 20% in humidity and about 25° C. in temperature.

What is claimed is:

1. A filling apparatus having a vertical tubular filing nozzle positioned above a path of transport of containers, and a lifter for lifting the container as transported to immediately below the filling nozzle from the path so as to insert the filling nozzle into the container when the container is to be filled, and a means for preventing condensation of water vapor on the filling nozzle, comprising:

a downwardly open dry air chamber having the filling nozzle accommodated therein and permitting the container to be moved into and out of the chamber when the container is lifted by the lifter, an injection nozzle disposed as oriented downward above the path upstream from the dry air chamber and movable downward with respect to the path for injecting dry air into the container to replace air therein, and a cover extending from a position downstream from the injection nozzle at least to the dry air chamber and covering the path from thereabove for preventing the dry air in the container from flowing out.

2. A device as defined in claim 1 wherein a liquid supply pipe extends through a top wall of the dry air chamber and is connected to the filling nozzle, and a dry air supply pipe is connected to a side wall of the dry air chamber.

3. A device as defined in claim 1 wherein the dry air chamber is internally provided with a guide for guiding the movement of the container to be lifted by the lifter.

4. A device as defined in claim 1 which further comprises a downwardly open suction chamber having the injection nozzle extending through a top wall thereof, a suction pipe being connected to a side wall of the suction chamber.

5. A device as defined in claim 1 wherein the the injection nozzle is movable upward and downward.

6. A device as defined in claim 1 wherein the the cover is provided with a skirt at each of its opposite side edges.

* * * * *